United States Patent [19]

Levy et al.

[11] Patent Number: 4,893,816

[45] Date of Patent: Jan. 16, 1990

[54] COMPETITIVE DICE AND CUBE GAME

[76] Inventors: Hal Levy; Brett M. Levy, both of 165 West End Ave., New York, N.Y. 10017

[21] Appl. No.: 289,805

[22] Filed: Dec. 23, 1988

Related U.S. Application Data

[63] Continuation-in-part of Ser. No. 155,080, Feb. 11, 1988, abandoned.

[51] Int. Cl.[4] ..... A63F 9/04

[52] U.S. Cl. ..... 273/146; 273/145 A; 273/145 CA

[58] Field of Search ..... 273/145 R, 145 A, 145 C, 273/145 CA, 146

[56] References Cited

U.S. PATENT DOCUMENTS

| | | | |
|---|---|---|---|
| 3,356,369 | 1/1967 | Stubbmann | 273/145 CA X |
| 3,516,672 | 6/1970 | Maurer | 273/145 CA X |
| 4,114,290 | 9/1978 | Cooper | 273/145 CA X |
| 4,521,197 | 6/1985 | Lumpkins | 273/146 X |
| 4,648,602 | 3/1987 | Maroney | 273/146 |

FOREIGN PATENT DOCUMENTS

| | | | |
|---|---|---|---|
| 206384 | 2/1909 | Fed. Rep. of Germany | 273/145 A |
| 361654 | 11/1931 | United Kingdom | 273/145 C |

*Primary Examiner*—Anton O. Oechsle
*Attorney, Agent, or Firm*—Peter L. Berger

[57] ABSTRACT

Dice game methods involving three dice and a doubling cube. The methods involve the providing of an objective total count to be reached to win the game, assigning a value to each face of the dice, permitting a first player to continue rolling as long as a certain minimum value is achieved for each roll, establishing an initial entry level beyond which the player can retain an accumulated count, permitting a player to stop rolling to fix his cumulative count and recommence accumulating a count during his next roll, returning the count to the last stopped cumulative count if the player does not achieve the minimum value on a given roll, and allowing the player whose turn is about to begin to offer the doubling cube to the opponent whereby the stakes are doubled if the opponent accepts the doubling cube or the game is won by the offering player if the opponent refuses to accept the doubling cube. In one embodiment, a structural member contains a compartment for the dice and another compartment for the doubling cube. Pressing the top of the dice compartment causes the dice to be tumbled. Alternatively, the dice and doubling cube can be carried in a carrier having a hinged side. The carrier also serves as a dice shaker.

8 Claims, 1 Drawing Sheet

COMPETITIVE DICE AND CUBE GAME

This application is a continuation in part of application Ser. No. 155,080, filed Feb. 11, 1988, abandoned.

BACKGROUND OF THE INVENTION

This invention relates to a competitive dice game which is Played with elements which are portable so that the game can be played anywhere and provides a unique and exciting competitive game experience.

There exist numerous games employing dice and other elements, frequently using game boards and pieces for moving the pieces around the game boards. One popular game is backgammon which is played with dice, a doubling cube, a board, pieces which move on the board and other associated elements. This game requires several independent elements and is difficult to easily transport and use without inconvenience.

There are numerous dice games in which dice are rolled, especially in betting environments. These games involve a single roller or player who is seeking to achieve a specific number with each roll, with there being no cumulative roll or count as the dice are repeatedly rolled by individual players in the game.

An object of this invention is to provide an improved competitive dice game which is susceptible to widespread use, easily portable and full of excitement and strategy suitable to players of different skill levels.

SUMMARY OF THE INVENTION

In accordance with the principles of this invention, the above objects are achieved by providing elements for a competitive dice game combination for at least two players, with the elements comprising at least two dice members which present at least three different values depending upon the side of the dice which turn up, a multiplier member selectively correlated with the cumulative values established by the dice members after repeated rolls, with the multiplier member being moveable between players, and means for carrying the elements together as an integral combination suitable for portability.

DETAILED DESCRIPTION

Figure 1:
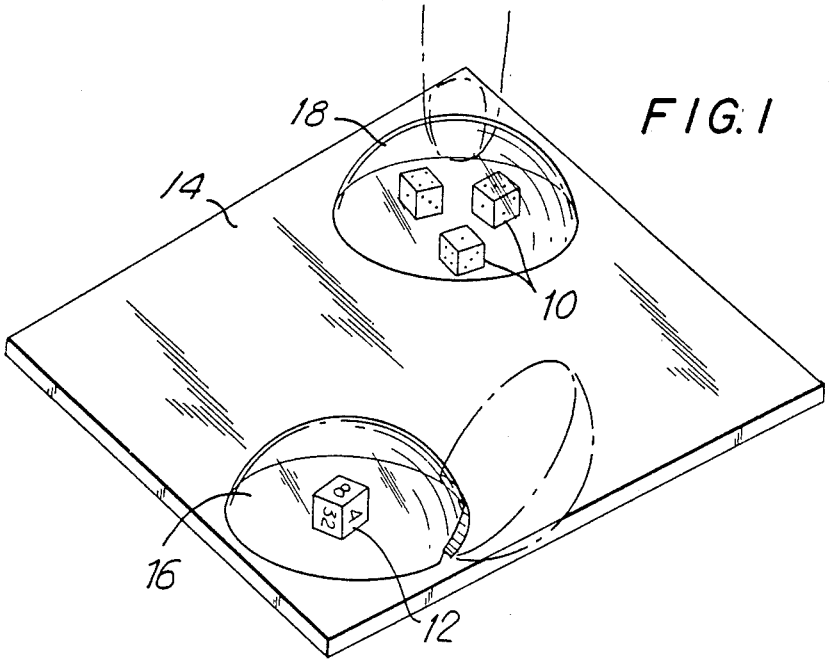
FIG. 1 is an embodiment of this invention illustrating the elements in a structural assembly.

This invention comprises the unique combination of dice 10 and a multiplier member 12 and means for carrying the elements together. One embodiment of this invention is shown in FIG. 1 which illustrates a structural member 14 with the dice 10 held in one compartment 18 and the multiplier member in another 16. The compartment for the dice is so constructed so that it may be operated by pressing its top 18 causing the dice to spring upwardly within the compartment to change value. The compartment 18 for the multiplier member can be opened to change its value selectively by either player, or in the alternative, it may also be randomly changed by pushing on the top of compartment 18 when constructed in a manner as identified above for compartment 16 for the dice.

Figure 2:
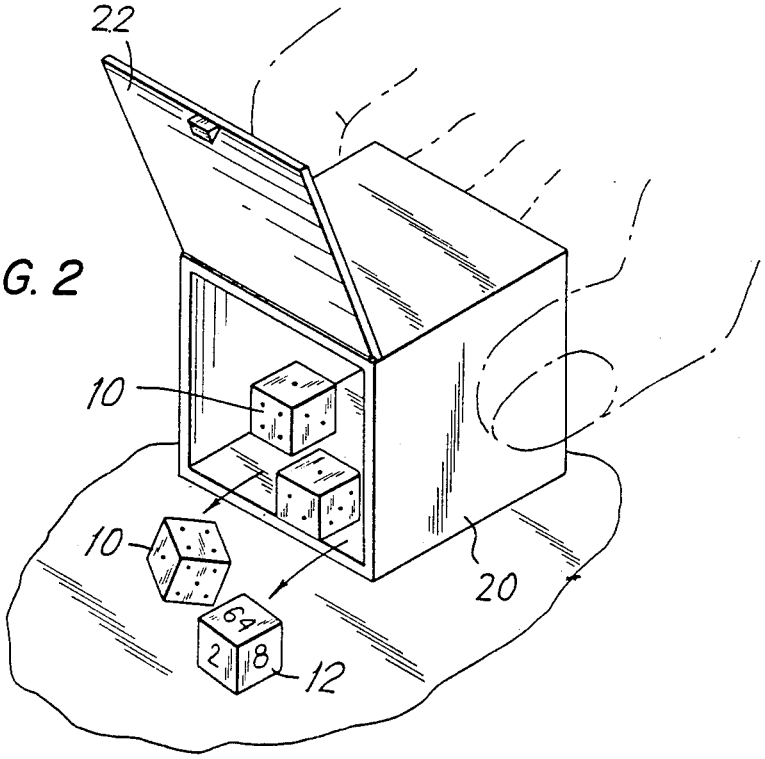
FIG. 2 is a perspective view of a carrier for the elements of the game which also serves as a shaker for the dice.

The dice 10 and multiplier 12 elements need not be formed as part of structure 14 as illustrated in FIG. 1, but can be loosely carried in a carrier 20 as illustrated in FIG. 2. The carrier 20 takes the form of a cube with one side hingedly attached to the carrier capable of being selectively opened or closed. The elements 10 and 12 can be packaged in carrier 20 and may be securely carried therein by maintaining side 22 closed. When the game is played side 22 is capable of being swung open and the carrier 20 serves as a shaker for the dice. Thus, the carrier serves both as a carrier and a shaker. All that is required to play this game are at least two players, a flat surface, and the invention. This game will enjoy widespread use for families and individual players who do not wish to carry bulky and cumbersome competitive playing games.

As an alternative, there may be three dice members, and they may be of the same color which can be different from the color of the multiplier element.

An illustrative game which may advantageously employ the members of the competitive dice game described above is illustrated hereinafter.

In this embodiment, the roll of the dice will produce either of three values, with the values being of either 0 points, 5 points or 10 points. Preferably, each dice member will have four faces having 0 points in value, one face having 5 points and the last face having 10 points. An initial entry amount is established between the players, and for instance, that value could be established at 15 points.

The game is played between two players with the first player rolling so long as he rolls at least 5 points. The player continues to roll until he fails to roll any points. If the player does not reach 15 points, the value accumulated will revert to 0 and no accumulation of value is achieved. The initial starting value could be 15, 40 or 75 points, as desired between the players.

Once the player reaches the established initial entry level, he can not lose that value but can only revert to it. As the player continues to roll at least 5 points, his culmulative count continues to increase. At ay point, he can stop his roll at a point value so that his next turn at rolling will not cause a diminution in culmulative value below the last stopped point value.

For instance, if the initial entry value is 40 and a player reaches 40, he can stop at that point and give the dice to the opponent to roll. If on the next roll the first player rolls and reaches 65, he can stop at that point giving the dice to the other player, so that the first player's count will always be at least 65. He continues to roll successively as long as he accumulates values of at least 5 points on each roll, but if he accumulates no points in any roll, the total point value accumulated from the last stop point value will be eradicated so that the player will return to value at the last stop point. The players can agree to an objective count to be reached which will determine the winner and the value of the game.

The multiplier element is used by either player at any time in the game and is put forth by the player about to start his play offering to the other player the opportunity to multiply the game value by the multiplier count. If the second player refuses to accept the game at the multiplied value, the game is over and the first player wins no matter his present count. On the other hand, if the second player chooses to accept the multiplied value for the game, the multiplier element is passed to the second player, the game continues, but the second player then controls the multiplier element and can present it to the first player at an appropriate time. It can be appreciated that the elements of chance play a large part in many aspects of this competitive dice game, but the added value employed by using the multiplier element as the game proceeds and its tactical choice at various points materially enhances the excitement of the game and the competitive aspects as well.

This invention provides the unique combination of playing elements combined together to provide and enhance an exciting competitive dice game which is new, novel and worthy of patent protection.

While the above description is illustrative of how the game of this invention is played, the following set of rules specifically described with reference to six-sided dice and a specific six-sided doubling cube further highlights and illustrates the invention.

RULES

Scoring

The game is played with three standard dice and one doubling cube. 2, 4, 6, 8, 16, 32 and 64 are on one six-sided doubling cube.

Only 5 and 6 count on a roll

5=50 points

6=100 points

The following illustrative rolls may be used as variants from the general rules of the game.

Special Pointscores

A roll of 3 6's=1,000 points 3 5's=500 points 3 4's=minus 400 points from point of previous roll 3 3's=minus 300 points from point of previous roll 3 2's=minus 200 points from point of previous roll 3 1's=minus 100 points from point of previous roll OBJECTIVE TOTAL CUMULATIVE COUNT—1500 Points Version A—To win a player rolls until at least 1,500 points is reached.

Version B—To win a player rolls until 1,500 points is exactly reached.

In order to have points count, a player must establish a initial count or entry level of at least 300 points on consecutive rolls. For example:

A player's first roll contains a six and a five; that is 150 points. On the second throw the player rolls a six; that is another 100 points, and on the third throw, the player rolls a five. Another 50 points is added for a total of 300 points and the player has reached the initial entry level and is BOARDED.

At this point, the player may stop and count those points as BOARDED or the player may continue rolling. If the player continues his sequence of rolls without giving the dice to another player and a 5 and 6 does not appear on a subsequent roll, he loses all accumulated points on that continuous sequence of rolls. Once a player is BOARDED, the player keeps these points and adds to this number on each successful turn. One alternative exception, as identified above, is when a player rolls three 4's, three 3's, three 2's or three 1's—that roll is deducted from the player's previous total.

Additional Scoring Features

When a player reaches 1,500 before the opponent has scored any points, the then current stakes are doubled.

The then current stakes are tripled if one player reaches 1,500 and the opponent has minus points.

Offering The Cube

The value of each game is one unit. If one player offers another player the multi-sided cube and the player accepts, the value of the game is doubled. The player accepting the cube now owns the cube, and only that player can offer to redouble the stakes. If the stakes are accepted, the value of the game is again doubled.

We claim:

1. A method of playing a game utilizing dice and a doubling cube comprising the steps of:

providing a objective total cumulative count to win the game, assigning a value to each face of the dice, establishing a value for each throw of the dice relating to the value assigned to each face of the cube of the dice, establishing an initial entry level to allow a player to continue accumulating and maintaining a cumulative count according to the throw of the dice, allowing a player to selectively stop at a retained cumulative count which is in excess of the initial value at any time during the player's turn, commencing the accumulation of said count during the player's next turn and allowing the player to selectively stop his turn at a second retained cumulative count, returning the count to the last stopped cumulative count depending upon the value of the throw of the dice whereby said player surrenders the newly accumulated count above that of the last set cumulative count and recommences his next turn at the last set cumulative count, providing a doubling cube to be selectively used by the player whose turn is about to begin, the player offering the doubling cube to the opponent whereby the stakes of the game are doubled if the opponent accepts the doubling cube or the game is won by the player if the opponent refuses to accept the doubling cube, the doubling cube remaining in the possession of the opponent for so long as the game continues or is offered to the first player by the opponent to redouble the stakes of the game, the game being won at the stakes then operative in the game by the use of the doubling cube when either player reaches the total objective cumulative count or a player refuses to accept the doubling cube.

2. A method of playing a game as claimed in claim 1, comprising the further step of winning the game only if the cumulative count exactly equals the objective total cumulative count.

3. A method of playing a game as claimed in claim 1, comprising the further step of winning the game if the cumulative count equals or is greater than the objective total cumulative count.

4. A method of playing a game as claimed in claim 1, providing the further step of increasing the stakes of the game if one player reaches the winning count before any other player has accumulated any points.

5. A method of playing a game utilizing dice and a doubling cube comprising the steps of:

providing an objective total count to be reached in order to win the game, assigning a value to each face of the dice, establishing a value for each throw of the dice according to the face of the dice then showing, permitting a player to continue his role so long as a certain minimum value is achieved for each role, establishing an initial entry level beyond which the player can retain an accumulated count, permitting a player to stop during his turn to fix his cumulative count at that reached at that point so long as that is in excess of said initial entry level, permitting said player to recommence accumulating a count during his next turn so long as he continues to roll at least said minimum value on each roll, reducing the prior fixed cumulative count if the player throws a certain combination during his turn, continuing the accumulation of said count by said player so long as he continues to roll and chooses not to stop, setting an accumulated count at any level as chosen by the player during his turn at which point the player then gives up his turn to the opponent, returning the accumulated count to the last fixed cumulative count if the player fails to reach set minimum value during any role in his turn, thereby terminating his turn, providing a doubling cube to be selectively used by the player whose turn is about to begin, the player offering the doubling cube to the opponent whereby the stakes of the game are doubled if said opponent accepts the doubling cube or e the game is won by player if the opponent refuses to accept the doubling cube, the doubling cube remaining in the possession of the opponent for so long as the game continues or is offered back to the first player by the opponent to redouble the stakes of the game, the game being won at the stakes then operative in the game according to the use of the doubling when either player reaches total objective cumulative count or a player refuses to accept the doubling cube.

6. A method of playing a game as claimed in claim 5, comprising the further step of winning the game only if the cumulative count exactly equals the objective total cumulative count.

7. A method of playing a game as claimed in claim 5, comprising the further step of winning the game if the cumulative count equals or is greater than the objective total cumulative count.

8. A method of playing a game as claimed in claim 5, providing the further step of increasing the stakes of the game if one player reaches the winning count before any other player has accumulated any points.

* * * * *